United States Patent [19]

Kofahl

[11] 4,401,159

[45] Aug. 30, 1983

[54] JET ENGINE PUMP AND DOWNHOLE HEATER

[75] Inventor: William M. Kofahl, Licking, Mo.

[73] Assignee: Flying K Equipment System, Inc., Licking, Mo.

[21] Appl. No.: 264,864

[22] Filed: May 18, 1981

[51] Int. Cl.[3] ..... E21B 36/02; E21B 43/24

[52] U.S. Cl. ..... 166/59; 166/302; 166/105; 417/364

[58] Field of Search ..... 166/302, 68, 59, 105, 166/369; 175/93; 165/51, 52, 45; 417/91, 59, 207, 364

[56] References Cited

U.S. PATENT DOCUMENTS

| | | | |
|---|---|---|---|
| 2,902,270 | 9/1959 | Salomonsson et al. | 166/59 X |
| 3,004,603 | 3/1958 | Rogers et al. . | |
| 3,216,498 | 11/1965 | Palm | 166/59 X |
| 3,606,999 | 9/1971 | Lawless . | |

*Primary Examiner*—Stephen J. Novosad

*Assistant Examiner*—Michael J. Starinshy

*Attorney, Agent, or Firm*—Jerry W. Mills

[57] ABSTRACT

A pumping system (10) is disclosed for pumping a fluid (14) from within a borehole (12) to the surface. A combustion engine (18) is employed to drive a pump comprising a pump barrel (28) and an auger pump shaft (32). The pumped fluid is carried from the borehole in a fluid return tubing string (42) having a standing valve (44) therein to prevent backflow into the borehole. A fuel-air mixture is provided to the combustion engine (18) through a fuel-air tubing string (22). A byproduct of the combustion of the fuel-air mixture is heat. The combusted mixture is exhausted from the combustion engine (18) through an engine exhaust tubing string (60). The engine exhaust tubing string includes a heating coil portion (64) forming a heat exchanger to transfer heat from the combusted fuel-air mixture to the fluid (14) adjacent the inlet of the pump to reduce the viscosity of the fluid to enhance the efficiency of the pumping system.

13 Claims, 1 Drawing Figure

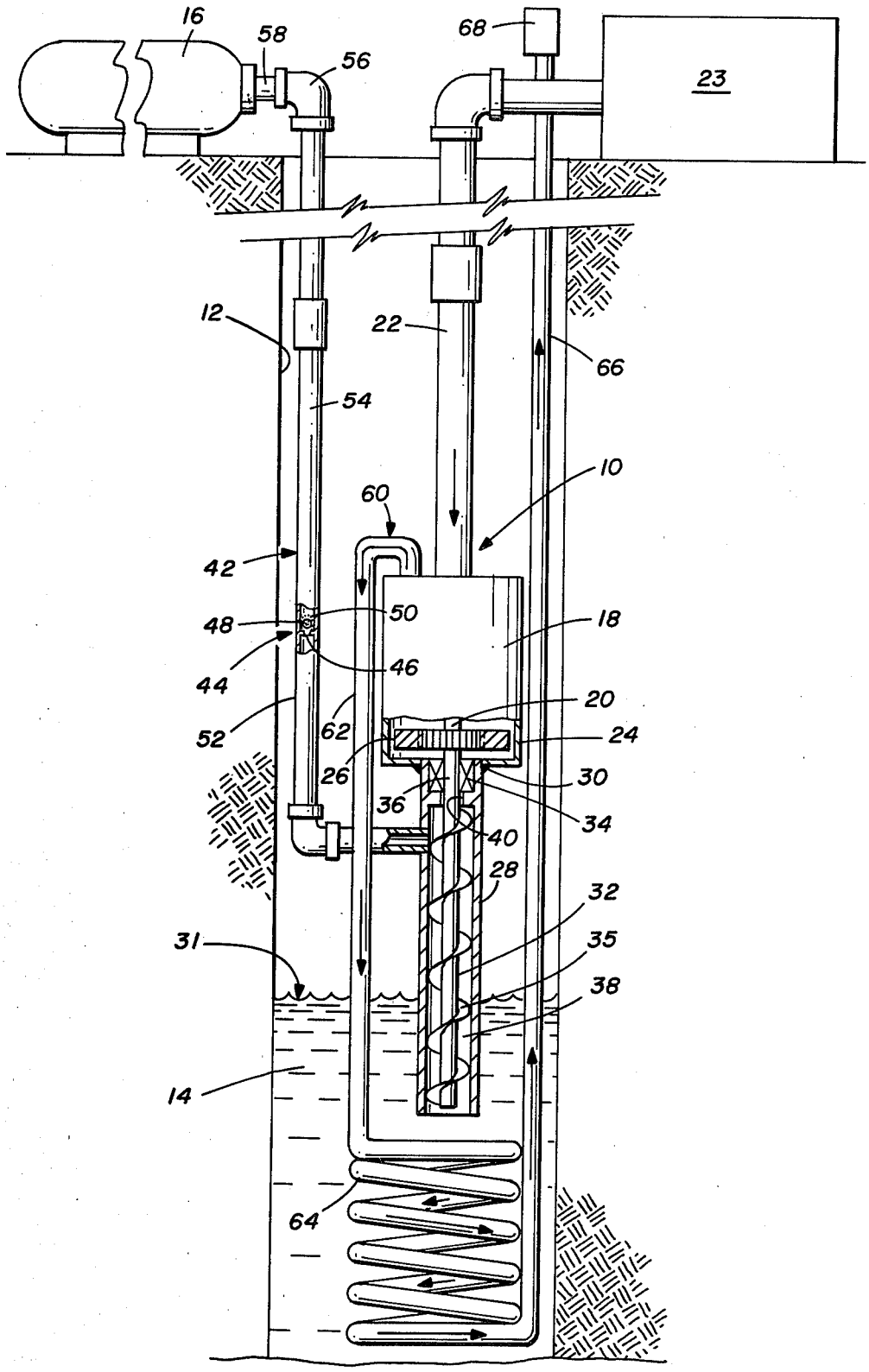
16
58
56
68
23
12
22
66
54
10
60
42
48
50
18
44
46
20
52
62
24
26
30
36
34
40
28
32
31
35
38
14
64

JET ENGINE PUMP AND DOWNHOLE HEATER

TECHNICAL FIELD

This invention relates to the pumping of fluids from one elevation to a higher second elevation, in particular, the invention relates to the pumping of oil from a borehole.

BACKGROUND ART

Recovery of oil and other precious fluids from the ground typically involves the drilling of a borehole to the depth necessary to reach the reservoir or pocket of oil. The drilling equipment is then removed and the borehole is lined with a casing to prevent collapse.

In the past, pumping units have been positioned on the surface adjacent the borehole for vertically reciprocating a string of sucker rods extending to a pump within the borehole. This type of pumping unit requires considerable space on the surface. In addition, the pumping unit must be aligned with the pump within the borehole so that pumping efficiency is not adversely affected and the sucker rod string and pump are not injured by the misalignment.

In many situations, the oil or fluid to be pumped to the surface has a viscosity so high that conventional pumping techniques are not effective. Some efforts have been made to heat oil within a borehole to reduce the viscosity of the oil to permit pumping by conventional techniques. These heating techniques have been independent of the pumping techniques and therefore require additional, complex and expensive equipment.

Therefore, a need has been shown to develop a pumping unit for cost effective and reliable pumping of a fluid which may operate on fluids having a wide range of viscosity.

DISCLOSURE OF THE INVENTION

In accordance with the present invention, a pump system for pumping fluid from a first elevation to a higher second elevation is provided. The pump includes a combustion engine for combustion of a fuel-air mixture. Pump structure is provided which is operable to draw fluid from the first elevation into a inlet and force the fluid drawn into the inlet through an outlet with sufficient energy to drive the fluid to the second elevation. The pump structure is operated by the combustion engine upon combustion of the fuel-air mixture therein. Structure is provided for supplying the combustion engine with the air-fuel mixture for combustion. A combustion exhaust tubing string is provided for carrying the combusted fuel-air mixture from the combustion engine. The combustion exhaust tubing string includes a heating coil positioned adjacent the fluid at the first elevation for heating the fluid to be pumped to reduce the viscosity thereof.

In accordance with another aspect of the present invention a pump system is provided for pumping fluid from a borehole which includes a combustion engine for rotating a drive shaft upon combustion of a fuel-air mixture. The combustion engine is adapted for placement within the borehole. A pump having an inlet and outlet is provided. The pump is operable to draw fluid from the borehole into the inlet and force fluid out of the outlet, the rotation of the shaft of the combustion engine operating the pump. A return tubing spring extends from the outlet for carrying the fluid to the surface, the tubing string has a standing valve therein separating the tubing string into upper and lower sections. The standing valve permits fluid flow only from the lower to upper section. A fuel-air mixture tubing string is provided for extension into the borehole to supply the combustion engine with fuel-air mixture for combustion. A combustion exhaust tubing string is provided for carrying the combusted fuel-air mixture from the combustion engine out of the borehole. The combustion engine tubing string has a heating coil therein for heating the fluid in the borehole with the combusted fuel-air mixture to reduce the viscosity thereof.

BRIEF DESCRIPTION OF THE DRAWINGS

A more complete understanding of the invention may be had by reference to the following Detailed Description when taken in conjunction with the accompanying Drawing, wherein:

FIG. 1 is a vertical cross-sectional view of a pumping system forming one embodiment of the present invention.

DETAILED DESCRIPTION

Referring now to the Drawing, wherein like reference characters designate like or corresponding parts throughout several views, FIG. 1 illustrates a pumping system 10 forming one embodiment of the present invention. The pumping system 10 may be supported within a borehole 12 for pumping the fluid 14 from within the borehole to the surface for storage in a tank 16.

The pumping system 10 includes a combustion engine 18 supported within a borehole. In the preferred embodiment, the combustion engine 18 comprises a jet turbine engine such as found on small jet aircraft. The combustion engine combusts a fuel-air mixture to provide the energy for rotating a drive shaft 20. The combustion engine 18 may be supported within the borehole by a fuel-air mixture tubing string 22 extending from the surface. The fuel-air tubing string also performs the function of providing the fuel-air mixture under pressure to the combustion engine for combustion from supply 23.

The drive shaft 20 enters a gear casing 24 having a speed reduction gear assembly 26 mounted therein. The gear casing 24 may be integral with the housing of engine 18. The drive shaft 20 is secured to one of the gears in the gear assembly 26 forming the high speed input.

A pump barrel 28 is secured to the gear housing 24 as by weld 30. The opposite end of the pump barrel 28 is open and is preferably under the surface 31 of the fluid 14 within borehole 12 when the pump system is properly positioned within the borehole. An auger cam or Archimedes screw-type pump shaft 32 is rotatably mounted within the pump barrel 28 by bearings 34. The auger pump shaft 32 includes a drive section 36 which enters the gear assembly 26 and forms the slow speed rotation output. The rotation of the drive shaft 20 at a relatively high rotational velocity rotates the auger pump shaft 32 with a greatly reduced rotational velocity. The pump shaft has a lower screw portion 35 for lifting fluids upon rotation thereof.

When the lower ends of both the pump barrel 28 and auger pump shaft 32 are positioned beneath the surface 31 of the fluid, rotation of the pump shaft 32 forces fluid upward in the annular section 38 between the pump shaft and pump barrel. Seals 40 are provided adjacent the bearings 34 to prevent fluid from entering the bearings and gear assembly. The pump barrel 28 includes an aperture near its upper end for connection to a fluid return tubing string 42 extending from the pump barrel to the surface. The rotation of the pump shaft 32 urges the fluid into the tubing string 42 and upward toward the surface. A standing valve 44 may be provided within the tubing string 42. The standing valve 44 includes an orifice 46, a ball 48 for sealing engagement with the orifice and cage 50 to maintain the ball 48 in close proximity with the orifice. The standing valve 44 divides the tubing string 42 into a lower section 52 and an upper section 54. The standing valve 44 permits fluid flow only from the lower section to the upper section. Therefore, should the pump system 10 cease operation, the fluid 14 in the upper section 54 of the tubing string 42 will not flow back into the borehole.

A connector 56 is secured at the upper end of the tubing string 42 and is further connected to a storage line 58. The storage line 58 extends into the storage tank 16 for storing the fluid pumped from the borehole.

The combusted fuel-air mixture is discharged from engine 18 through an engine exhaust tubing string 60. The tubing string 60 includes a downwell casing portion 62 extending downward into the borehole from the combustion engine. The downwell casing portion 62 extends to a heating coil portion 64 positioned adjacent the open end of the pump barrel 28. The heating coil portion 62 includes a number of turns of tubing as shown in FIG. 1 which provides effective heat transfer from the combusted mixture within the tubing to the surrounding fluid 14. An upwell casing portion 66 extends from the opposite end of the heating coil portion 64 upward to the surface. The cooled combusted fuel-air mixture is then exhausted to the atmosphere through muffler 68.

The pumping system 10 is therefore operable to pump fluid 14 out of a borehole 12. In addition, the combusted fuel-air mixture at elevated temperatures is employed through the heating coil portion 64 to heat the fluid 14 surrounding the entrance of the pump barrel 28 to reduce the viscosity of the fluid 14 to reduce the energy necessary to pump the fluid to the surface.

In one proposed construction of the pumping system 10, a jet aircraft engine is employed as the combustion engine 18. The combusted fuel-air mixture exhausted from the aircraft engine will have a temperature about 2100° F.

In the embodiment described above, the engine 18 and pump are supported in the borehole. The engine 18 can be put at the surface adjacent the borehole if desired. The pump may also be positioned at the surface by modifying the pump to extend from the surface to the fluid 14 to be pumped.

Although a single embodiment of the invention has been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. A pump system for pumping fluid from a borehole, comprising:

a combustion engine having drive shaft means for imparting motion to the drive shaft means upon combustion of a fuel-air mixture, a byproduct of the combustion being heat in the combusted fuel-air mixture;

pump means directly coupled to the drive shaft means, the motion of the drive shaft means operating said pump means to draw fluid in the borehole into an inlet and pumping the fluid through an outlet out of the borehole; and exhaust tubing string means for carrying the combusted fuel-air mixture from said combustion engine, said exhaust tubing string means having a heat exchanger portion for transferring heat from the combusted fuel-air mixture to the fluid to be drawn by said pump means to reduce the viscosity thereof.

2. The pump system of claim 1 wherein the fluid pumped from the first elevation to the second elevation comprises a fluid hydrocarbon.

3. The pump system of claim 1 wherein said combustion engine comprises a turbine engine for rotating the drive shaft means.

4. The pump system of claim 3 further comprising a reduction gear assembly interconnecting the drive shaft means and said pump means to permit the pump means to be operated at lower rotational velocity than the turbine engine.

5. The pump system of claim 1 wherein said pump means includes standing valve means, said standing valve means preventing backflow of fluid pumped therethrough by said pump means upon cessation of motion in the drive shaft means.

6. A pump system for pumping fluid from a borehole comprising:

a combustion engine for rotating a drive shaft upon combustion of a fuel-air mixture, a byproduct of the combustion being heat in the combusted fuel-air mixture;

a pump connected to the drive shaft, the rotation of the drive shaft operating said pump to draw fluid in the borehole into an inlet and pumping the fluid through an outlet out of the borehole;

a return tubing string extending from the outlet of said pump for carrying the pumped fluid to the surface, said return tubing string having a standing valve therein separating said return tubing string into upper and lower sections, the standing valve permitting fluid flow only from the lower to upper section;

a fuel-air mixture tubing string for extension into the borehole to supply said combustion engine with fuel-air mixture for combustion; and a combustion exhaust tubing string for carrying the combusted fuel-air mixture from said combustion engine out of the borehole, said combustion exhaust tubing string having a heat exchange section within the borehole for heating the fluid in the borehole drawn into the inlet of said pump with the combusted fuel-air mixture to reduce the viscosity thereof.

7. The pump system of claim 6 wherein said fluid comprises a fluid hydrocarbon.

8. The pump system of claim 6 wherein said combustion engine comprises a turbine engine rotating the drive shaft, said pump system further comprising a reduction gear assembly interconnected between the drive shaft and said pump so that said pump may be operated at a lower rotational velocity than the turbine engine.

9. The pump system of claim 6 wherein said pump includes a pump barrel having one end open for extension into the fluid in the borehole and an auger pump shaft supported for rotational motion within said pump barrel, a portion of said auger pump shaft adjacent the open end of said pump barrel being positioned for extension into the fluid within the borehole, an annular chamber being defined between said pump barrel and said auger pump shaft, said return tubing string extending in fluid communication with the annular chamber, the rotation of the drive shaft rotating said auger pump shaft to urge fluid into the annular chamber and into said return tubing string for movement out of the borehole.

10. A pump system for pumping fluid from a borehole, comprising:

a combustion engine for rotating a drive shaft upon combustion of a fuel-air mixture, said combustion engine being adapted for placement within the borehole, a byproduct of the combustion being heat in the combusted fuel-air mixture;

an auger pump shaft operatively connected to said drive shaft, one end of said auger pump shaft adapted for extension into the fluid in the borehole;

a pump barrel secured in a fixed relationship to said combustion engine and extending concentrically with said auger pump shaft, a portion of said pump barrel adapted for extension into the fluid within the borehole, said pump barrel and auger pump shaft defining an annular chamber therebetween;

a return tubing string extending from the annular chamber for carrying fluid out of the borehole, said return tubing string having a standing valve therein separating said return tubing string into upper and lower sections, the standing valve permitting fluid flow only from the lower to upper sections;

a fuel-air mixture tubing string for extension into the borehole to supply said combustion engine with fuel-air mixture for combustion; and a combustion exhaust tubing string for carrying the combusted fuel-air mixture from said combustion engine out of the borehole, said combustion exhaust tubing string having a heat exchanger section thereon for heating fluid in the borehole adjacent the ends of said pump barrel and auger pump shaft within the fluid in the borehole to heat the fluid to be pumped from the borehole to reduce the viscosity thereof.

11. The pump system of claim 10 wherein the fluid in the borehole comprises a fluid hydrocarbon.

12. The pump system of claim 10 wherein said combustion engine comprises a turbine engine.

13. The pump system of claim 10 further comprising a reduction gear assembly operatively interconnected between the drive shaft and said pump to permit the drive shaft to rotate at a greater rotational velocity than said pump.

* * * * *